US006491167B2

(12) United States Patent
Mahrenholtz et al.

(10) Patent No.: US 6,491,167 B2
(45) **Date of Patent: *Dec. 10, 2002**

(54) SELF-CLEANING SEPARATOR FOR COHESIVE OR ADHESIVE PRODUCTS

(75) Inventors: Jochen Mahrenholtz, Krefeld (DE); Jörg-Rainer Schmitz, Duisburg (DE); Klaus-Michael Zeyen, Pulheim (DE); Oliver Fleschenträger, Kerken (DE)

(73) Assignee: Bayer Aktiengesellschaft, Leverkusen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/467,702

(22) Filed: Dec. 20, 1999

(65) Prior Publication Data

US 2002/0014442 A1 Feb. 7, 2002

(30) Foreign Application Priority Data

Dec. 21, 1998 (DE) ..... 198 58 966

(51) Int. Cl.[7] ..... B04C 3/06; B04C 5/22
(52) U.S. Cl. ..... 209/722; 209/133; 209/155
(58) Field of Search ..... 209/133, 139.1, 209/142, 722, 155

(56) References Cited

U.S. PATENT DOCUMENTS 3,669,503 A * 6/1972 Zimmermann ..... 302/64
3,902,601 A * 9/1975 Townley ..... 209/144
4,202,139 A * 5/1980 Hong et al. ..... 51/393
4,623,458 A * 11/1986 Hakola ..... 210/238
4,808,469 A * 2/1989 Hiles ..... 428/318.6

OTHER PUBLICATIONS

Mark's Standard Handbook for Mechanical Engineers, Tenth Edition, Eugene A. Avallone and Theodore Baumeister III, McGraw–Hill Publishers, Copyright 1996.*

* cited by examiner

*Primary Examiner*—Donald P. Walsh
*Assistant Examiner*—Daniel K Schlak
(74) *Attorney, Agent, or Firm*—Joseph C. Gil; Noland J. Cheung; Thomas W. Roy

(57) ABSTRACT

A self-cleaning separator is described for cohesive or adhesive solids from a fluidborne stream of solids on the basis of a cyclonelike separation. The separator consists at least of a cylindrical upper section (8) having a separating chamber (3), a product inlet (2), a fluid outlet (5), and of a conical lower section (6) having a solids outlet (7) adjoining below the lower section (6), at least the side wall (4) of the upper section (8) being produced from an elastic material, in particular an elastomeric material.

7 Claims, 1 Drawing Sheet

SELF-CLEANING SEPARATOR FOR COHESIVE OR ADHESIVE PRODUCTS

FIELD OF THE INVENTION

The invention relates to a self-cleaning separator for cohesive or adhesive solids from a fluidborne stream of solids on the basis of a cyclonelike separation by means of which cohesive or adhesive products can be removed without fouling. The separator in this case is operated without an additional cleaning mechanism and is particularly suitable for removing weighed products from pneumatic conveying lines when there is a requirement for high metering accuracy in conveying and separation.

BACKGROUND OF THE INVENTION

Separators for pneumatic systems for conveying solids through pipelines are known in the literature and have been described at length on numerous occasions (Examples: R. D. Marcus et al.: "Pneumatic conveying of solids", St. Edmundsbury Press, page 361–409, Bury St. Edmunds, GB, 1990; W. Siegel: "Pneumatische Förderung", Vogel Buchverlag, page 243–259, Würzburg, D, 1991).

In this context the mention of cyclone separation occurs frequently, which has been known in principle since the end of the last century (cf.: R. Nagel: "Der Zyklon als Staubabscheider", BWK Vol. 3, No. 10, pp. 331–335, October 1951).

A disadvantage of this method is that its use is restricted to readily flowable products, since otherwise these products remain adhering to the wall of the separator and thus cannot be fully discharged. This also applies to the case in which the fouling flakes off again at irregular intervals in the case of batchwise conveying, since in this case there are fluctuations between the individual conveying cycles in terms of the amount of product discharged.

In order to avoid fouling, conventionally a description is given of jacketed separators with pneumatic or mechanical cleaning by means of shakers, strikers, or paddle equipment [in accordance with the silo discharge aids as per D. Schulze "Austragsorgane und Austragshilfen", Preprints, Lecture and Discussion Conference "Agglomerations- und Sch üttguttechnik", pp. 139–166, Baden-Baden 1991] or cyclones with an additional vibration apparatus [JP 92-215316] are used.

A disadvantage with these systems is the additional, complex cleaning unit in order to avoid fouling.

SUMMARY OF THE INVENTION

The invention is based on the object of developing a separator for pneumatic conveying systems which is self-cleaning and with which it is possible to perform virtually complete removal of cohesive or adhesive products without fouling on the separator walls.

The object is achieved in accordance with the invention by using a self-cleaning separator for cohesive or adhesive solids from a fluidborne stream of solids on the basis of a cyclonelike separation, the said separator consisting at least of a cylindrical upper section having a separation chamber, a product inlet, a fluid outlet, and of a conical lower section having a solids outlet adjoining below the lower section, and is characterized in that at least the side wall of the upper section consists of an elastic material, in particular an elastomeric material.

DETAILED DESCRIPTION OF THE INVENTION

Figure 1:
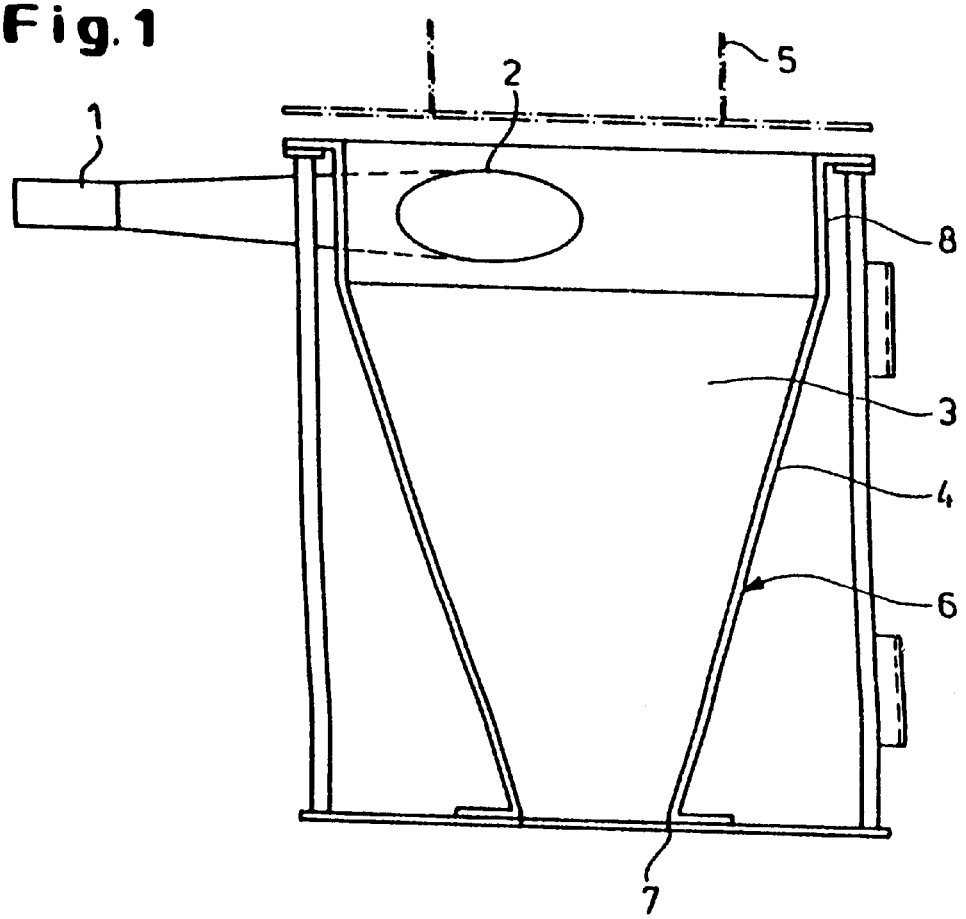
FIG. 1 shows a view of the diagrammatic longitudinal section through a separator of the present invention.
Figure 2:
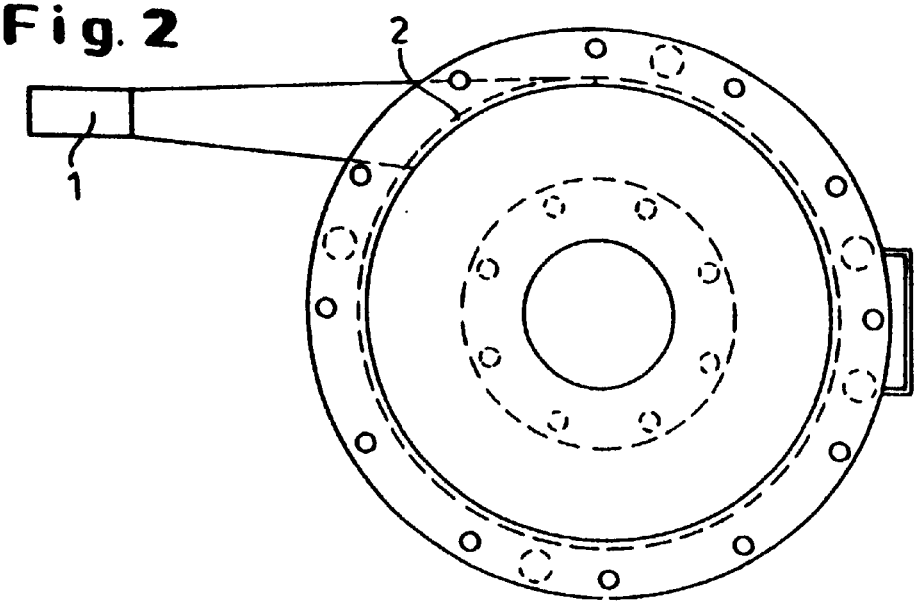
FIG. 2 shows a view of the diagrammatic cross-section through a conveyor of the present invention at the level of the product inlet.

One preferred embodiment is characterized in that the centre axis of the product inlet is arranged tangentially to the cylindrical upper section of the separator.

In one preferred form of the separator the fluid outlet is designed as a dip pipe which protrudes at least to below the lower edge of the inlet into the separating chamber.

One particular form of the separator is characterized in that the lower section is inclined by an angle of <45°, in particular <30°, to the perpendicular of the wall of the upper section.

The conveying medium leaves the separator preferably through a central aperture in the lid, with particular preference without a dip pipe. The product can preferably be taken off via a central aperture in the base.

The use of a separator of the invention suppresses the fouling of the inner wall of the separating chamber byproduct owing to vibrations which occur in the wall because of the conveying pulse. This is supported by the separator expanding during the conveying cycle but contracting back in on itself after the conveying air has been shut off. The two influencing factors make it possible for temporary fouling to flake off again immediately.

Suitable wall materials are all elastic materials which are known per se. With preference, it is possible to use antistatic, electrically conductive or corrosion-resistant materials. Particular preference is given to elastomeric polymers comprising polyurethane (PU), polyvinyl chloride (PVC), silicone, synthetic or non-synthetic rubber (e.g. EPDM rubbers), or polyethylene (PE).

Connection elements (e.g. the inlet port) are preferably flange or clamp connections and need not necessarily be manufactured from the same material as the separator wall itself.

The product is supplied preferably by way of a hose line, with particular preference being a polyurethane hose line.

The solid is taken off preferably by means of a slide valve or plug valve, with particular preference being a ball valve.

The conveying fluid is air or nitrogen and on emergence from the outlet port is preferably supplied to a filter which may be both mounted on the separator and also connected to the separator by way of an additional line, preferably a hose line.

Particular preference is given to the use of a pressure vessel conveyor with multiple afterblowing.

It has surprisingly been found that the conveying pulse from the pneumatic conveyor upstream of the separator is sufficient to cause virtually complete prevention of fouling on the inner wall of the separator even in the case of extremely cohesive or adhesive products.

The elastic material of the side wall of the separator is selected in particular from the group consisting of polyurethane, polyvinyl chloride, silicone, polyethylene, synthetic rubber and non-synthetic rubber, e.g. EPDM rubber.

A separator with a particularly simple self-cleaning action is characterized in that the lid of the separator likewise consists of the same elastic material as the side wall.

The invention additionally provides for the use of the separator of the invention for removing solids in pneumatic conveyor systems.

The separator of the invention is particularly suitable for use in pneumatic conveyor systems where the product is weighed before being conveyed, and thus where no fluctuations in amount of product can be allowed to occur in the course of conveying and separation. Particular preference is given to applications for conveying powders and granules having a fine particle fraction.

These can be, for example, pigments in a mixer.

The invention is illustrated by way of example below on the basis of the Figures without the invention being specifically restricted as a result.

EXAMPLES

The separating device used for the examples has the following construction (see FIG. 1). The separator is divided into a cylindrical upper section 8 and a conical lower section 6. Upper section 8 and lower section 6 circumscribe a separating chamber 3. Provided on the cylindrical upper section 8 is an inlet 2 for the product to be removed, and an outlet 5 for the transporting fluid which is separated off. The inlet 2 communicates with a conveying line, which is not shown. Mounted below the conical lower section 6 is a solids outlet 7.

In the following examples a separator was used which had an upper section 8 made from Mipolan (a plasticized PVC) with a wall thickness (item 4) of 8 mm. The flexible upper section 8 is supported mechanically by the cylinder housing 9 and the flange 10.

The conveying and removal properties of the separator were investigated using two different iron oxides. The two types differ in their flowability, their cohesiveness and their integrity.

30 runs were carried out with in each case 5 kg of product being metered, conveyed, removed and individually reweighed.

The same runs were also carried out with a conventional metallic separator and were subsequently evaluated.

Following the runs, the entire separating unit was broken down into its individual components and these were cleaned, the adhered product on the individual components being collected and weighed.

When this was done, the following amounts of adhered product were found on the separator:

| | Product type 1 | Product type 2 |
|---|---|---|
| Metallic separator: | 607 g | 295 g |
| Separator of the invention: | 44 g | 26 g |

Whereas the adhered product in the case of the known metallic separator can be traced back to a layer up to 8 mm thick, the amount of adhered product in the case of the separator of the invention results from a dust layer whose thickness is below the measurable range.

When a separator of the invention is used, the amounts of adhered product undergo only a negligible increase when more than 20 t of cohesive pigment is conveyed.

What is claimed is:

1. A self-cleaning separator for separating cohesive or adhesive solids from a fluidborne stream of solids on the basis of a cyclonelike separation, comprising a cylindrical upper section defined by a wall and having a separating chamber, a product inlet, and a fluid outlet; and a lower section defined by a wall that tapers conically downwards and having a solids outlet adjoining below the lower section, wherein the walls of the upper and lower sections are made from an elastomeric material and also wherein the walls of the upper and lower sections are not jacketed.

2. A separator according to claim 1, wherein a center axis of the product inlet is arranged tangentially to the cylindrical upper section of the separator.

3. A separator according to claim 1, wherein the fluid outlet is designed as a dip pipe which protrudes at least to below a lower edge of the inlet into the separating chamber.

4. A separator according to claim 1, wherein the lower section is inclined by an angle of <45° to a line perpendicular to the wall of the upper section.

5. A separator according to claim 4, wherein said angle is <30°.

6. A separator according to claim 1, wherein the elastomeric material is selected from the group consisting of polyurethane, polyvinyl chloride, silicone, polyethylene, synthetic rubber and non-synthetic rubber.

7. A separator according to claim 1, wherein said synthetic rubber is EPDM rubber.

* * * * *